US011011105B2

(12) United States Patent
Wang et al.

(10) Patent No.: US 11,011,105 B2
(45) Date of Patent: May 18, 2021

(54) PIXEL CIRCUIT

(71) Applicant: Au Optronics Corporation, Hsinchu (TW)

(72) Inventors: Hsien-Chun Wang, Hsinchu (TW); Ya-Jung Wang, Hsinchu (TW); Jing-Wun Jhang, Hsinchu (TW); Chen-Feng Fan, Hsinchu (TW); Wan-Heng Chang, Hsinchu (TW); Sung-Yu Su, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 16/828,928

(22) Filed: Mar. 24, 2020

(65) Prior Publication Data

US 2021/0056889 A1 Feb. 25, 2021

(30) Foreign Application Priority Data

Aug. 20, 2019 (TW) ..... 108129607

(51) Int. Cl.
*G09G 3/32* (2016.01)

(52) U.S. Cl.
CPC ..... *G09G 3/32* (2013.01); *G09G 2300/0465* (2013.01); *G09G 2310/027* (2013.01); *G09G 2310/0267* (2013.01)

(58) Field of Classification Search
CPC ..... G09G 3/32
See application file for complete search history.

(56) References Cited

U.S. PATENT DOCUMENTS

| | | | | |
|---|---|---|---|---|
| 8,686,931 | B2 | 4/2014 | Ota | |
| 8,803,927 | B2 | 8/2014 | Wu et al. | |
| 9,746,979 | B2 | 8/2017 | Yang | |
| 10,475,371 | B2 * | 11/2019 | Cheng | H01L 51/5036 |
| 10,783,830 | B1 * | 9/2020 | Lu | G09G 3/3233 |
| 2010/0127956 | A1 * | 5/2010 | Kang | G09G 3/3233 345/76 |

(Continued)

FOREIGN PATENT DOCUMENTS

| | | |
|---|---|---|
| CN | 107316614 | 11/2017 |
| CN | 109887464 | 6/2019 |

(Continued)

*Primary Examiner* — Fred Tzeng
(74) *Attorney, Agent, or Firm* — JCIPRNET

(57) ABSTRACT

A pixel circuit includes a light-emitting device, a first transistor, a second transistor, a first capacitor, a third transistor, a fourth transistor, and a fifth transistor. The first transistor and the fourth transistor are controlled by a light-emitting signal. The third transistor and the fifth transistor are controlled by a scan signal. The light-emitting device, the first transistor, the second transistor, the fourth transistor, and the fifth transistor are serially connected between a system high voltage and a system low voltage. The third transistor is coupled between a data signal and a control terminal of the first transistor. The first capacitor is coupled between a control terminal and a downstream terminal of the second transistor. The fifth transistor is coupled between the downstream terminal of the second transistor and a charging reference voltage. A current of the charging reference voltage is less than a current of the system low voltage.

20 Claims, 4 Drawing Sheets

(56) References Cited

U.S. PATENT DOCUMENTS

| | | | | |
|---|---|---|---|---|
| 2011/0242072 | A1 | 10/2011 | Ota | |
| 2015/0049006 | A1* | 2/2015 | Sun | G09G 3/3266 345/76 |
| 2015/0161944 | A1* | 6/2015 | Gai | G09G 3/3233 345/78 |
| 2016/0140904 | A1* | 5/2016 | Wu | G09G 3/3233 345/78 |
| 2016/0224157 | A1 | 8/2016 | Yang | |
| 2017/0178569 | A1* | 6/2017 | Hu | G09G 3/3266 |
| 2018/0301092 | A1* | 10/2018 | Ma | G09G 3/3233 |

FOREIGN PATENT DOCUMENTS

| | | |
|---|---|---|
| CN | 110767154 | 2/2020 |
| JP | 2011221070 | 11/2011 |
| WO | 2015192503 | 12/2015 |

* cited by examiner

PIXEL CIRCUIT

CROSS-REFERENCE TO RELATED APPLICATION

This application claims the priority benefit of Taiwan patent application serial no. 108129607, filed on Aug. 20, 2019. The entirety of the above-mentioned patent application is hereby incorporated by reference here and made a part of this specification.

BACKGROUND

Technical Field

The disclosure relates to a pixel circuit, and more particularly, to a pixel circuit of a self-luminous display panel.

Description of Related Art

In a display panel, trace impedance within the panel may lead to different voltage attenuations when a current flows, thus resulting in different system high voltage and system low voltage in the panel and posing an impact on the current flowing through a transistor controlling the luminous current in a pixel circuit, whereby the brightness produced by a light-emitting device is affected. Although the transistor controlling the luminous current is operated in a saturation region to reduce the impact of the trace impedance, the trace impedance at different locations may result in different voltage drops, which still affects the brightness uniformity of the display panel. Accordingly, a pixel circuit that may better resolve said issue or suppress the trace impedance is needed.

SUMMARY

The disclosure provides a pixel circuit to lessen or suppress the impact of trace impedance on the pixel circuit, so as to enhance brightness uniformity of a display panel.

In an embodiment of the disclosure, a pixel circuit including a light-emitting device, a first transistor, a second transistor, a first capacitor, a third transistor, a fourth transistor, and a fifth transistor is provided. The light-emitting device has an anode that receives a system high voltage and a cathode. The first transistor has a first terminal coupled to the cathode of the light-emitting device, a second terminal, and a control terminal receiving a light-emitting signal. The second transistor has a first terminal coupled to the second terminal of the first transistor, a second terminal, and a control terminal. The first capacitor has a first terminal coupled to the control terminal of the second transistor and a second terminal coupled to the second terminal of the second transistor. The third transistor has a first terminal receiving a first data signal, a second terminal coupled to the control terminal of the second transistor, and a control terminal receiving a first scan signal. The fourth transistor has a first terminal coupled to the second terminal of the second transistor, a second terminal receiving a system low voltage, and a control terminal receiving the light-emitting signal. The fifth transistor has a first terminal coupled to the second terminal of the second transistor, a second terminal receiving a charging reference voltage, and a control terminal receiving the first scan signal. A first current value of the charging current reference voltage provided to the fifth transistor when the fifth transistor is turned on is smaller than a second current value of the system low voltage provided to the fourth transistor when the fourth transistor is turned on.

In view of the foregoing, the pixel circuit provided in one or more embodiments of the disclosure performs writing of a data voltage (i.e., charging of the first capacitor) through a low-current charging reference voltage, so as to lessen the influence of the trace impedance when the data voltage is written into the first capacitor and improve brightness uniformity of the display panel.

Several exemplary embodiments accompanied with figures are described in detail below to further describe the disclosure in details.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles described herein.

DESCRIPTION OF THE EMBODIMENTS

Figure 1A:
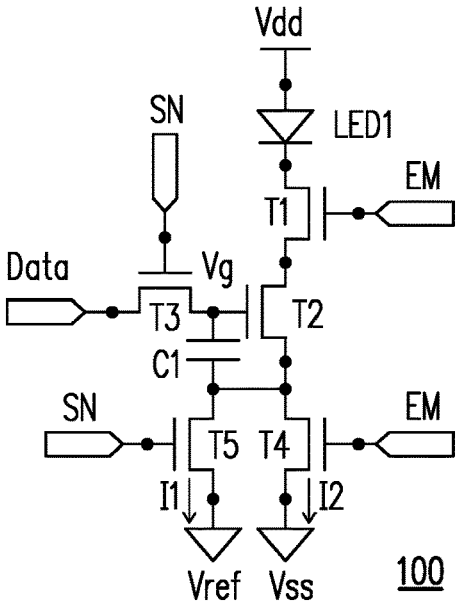
FIG. 1A is a schematic circuit diagram of a pixel circuit according to a first embodiment of the disclosure.

Reference will now be made in detail to the present preferred embodiments of the disclosure, examples of which are illustrated in the accompanying drawings. Wherever possible, the same reference numbers are used in the drawings and the description to refer to the same or like parts.

Various embodiments of the disclosure are disclosed in the drawings, and for the sake of clarity, many of the practical details are set forth in the following description. However, it should be understood that these practical details should not be used to limit the disclosure. In other words, these practical details are not necessary in certain embodiments of the disclosure. In addition, to simplify the drawings, some conventional structures and elements in the drawings will be shown in a simple and schematic manner.

Throughout the specification, the same reference numerals in the accompanying drawings denote the same or similar elements. In the accompanying drawings, thicknesses of layers, films, panels, regions and so on are exaggerated for clarity. It should be understood that when an element such as a layer, film, region or substrate is referred to as being "on" or "connected to" another element, it can be directly on or connected to the other element, or intervening elements may also be present between said element and said another element. In contrast, when an element is referred to as being "directly on" or "directly connected to" another element, there are no intervening elements present between said element and said another element. As used herein, the term "connected" may refer to physically connected and/or electrically connected. Therefore, intervening elements may be present between two elements when the two elements are "electrically connected" or "coupled" to each other.

It should be understood that, although the terms "first", "second", etc., may be used herein to describe various elements, components, regions, layers and/or sections, these elements, components, regions, layers, and/or sections should not be limited by these terms. These terms are used to distinguish one element, component, region, layer or section from another element, component, region, layer or section.

The terminology used herein is for the purpose of describing particular embodiments and is not intended to be limiting of the disclosure. As used herein, the singular forms "a", "an" and "the" are intended to include the plural forms as well, unless the context clearly indicates otherwise. Herein, "or" represents "and/or". The term "and/or" used herein includes any or a combination of one or more of the associated listed items. It will be further understood that the terms "comprises", "comprising", "includes" and/or "comprising", when used herein, specify the presence of stated features, regions, integers, steps, operations, elements, and/or components, but do not preclude the presence or addition of one or more other features, regions, integers, steps, operations, elements, components, and/or groups thereof.

Moreover, relative terms such as "below" or "bottom" and "above" or "top" may serve to describe the relation between one element and another element in the text according to the illustration of the drawings. It should also be understood that the relative terms are intended to include different orientations of a device in addition to the orientation shown in the drawings. For example, if a device in the drawings is flipped, an element described as being disposed "below" other elements shall be re-orientated to be "above" other elements. Thus, the exemplary term "below" may cover the orientations of "below" and "above", depending on a specific orientation of the drawings. Similarly, if a device in a figure is flipped over, the element originally described to be located "below" or "underneath" other element is oriented to be located "on" the other element. Therefore, the illustrative term "under" or "below" may include orientations of "above" and "under".

The term "approximately" or "substantially" as used herein is inclusive of the stated value and means within an acceptable range of deviation for the particular value as determined by persons of ordinary skill in the art, considering the measurement in question and the error associated with measurement of the particular quantity (i.e., the limitations of the measurement system). For example, "approximately" may mean within one or more standard deviations, or within, for example, ±30%, ±20%, ±15%, ±10%, ±5% of the stated value. Moreover, a relatively acceptable range of deviation or standard deviation may be chosen for the term "approximately" or "substantially" as used herein based on optical properties, etching properties or other properties, instead of applying one standard deviation across all the properties.

Unless otherwise defined, all terms (comprising technical and scientific terms) used herein have the same meaning as commonly understood by persons of ordinary skill in the art. It will be further understood that terms, such as those defined in commonly used dictionaries, should be interpreted as having a meaning that is consistent with their meaning in the context of the relevant art and the disclosure and will not be interpreted in an idealized or overly formal sense unless expressly so defined herein.

FIG. 1A is a schematic circuit diagram of a pixel circuit according to a first embodiment of the disclosure. With reference to FIG. 1A, in an embodiment, a pixel circuit 100 includes a light-emitting device, e.g., a micro light-emitting diode LED1 and/or an organic light-emitting diode (OLED), a first transistor T1, a second transistor T2, a third transistor T3, a fourth transistor T4, a fifth transistor T5, and a first capacitor C1, wherein the first transistor T1, the second transistor T2, the third transistor T3, the fourth transistor T4, and the fifth transistor T5 may be thin film transistors (TFTs), which should not be construed as a limitation in the disclosure.

The light-emitting device, e.g., the micro light-emitting diode LED1, has an anode receiving a system high voltage Vdd and a cathode. The first transistor T1 has a first terminal coupled to the cathode of the micro light-emitting diode LED1, a second terminal, and a control terminal that receives a light-emitting signal EM. The second transistor T2 has a first terminal coupled to the second terminal of the first transistor T1, a second terminal, and a control terminal. The first capacitor C1 has a first terminal coupled to the control terminal of the second transistor T2 and a second terminal coupled to the second terminal of the second transistor T2.

The third transistor T3 has a first terminal that receives a first data signal Data, a a second terminal coupled to the control terminal of the second transistor T2, and a control terminal that receives a first scan signal SN. The fourth transistor T4 has a first terminal coupled to the second terminal of the second transistor T2, a second terminal receiving a system low voltage Vss, and a control terminal receiving the light-emitting signal EM. The fifth transistor T5 has a first terminal coupled the second terminal of the second transistor T2, a second terminal receiving a charging reference voltage Vref, and a control terminal receiving the first scan signal SN.

In this embodiment, the charging reference voltage Vref may be a direct current (DC) voltage of zero volt, and a first current value I1 of the charging reference voltage Vref provided to the fifth transistor T5 when the fifth transistor T5 is turned on is smaller than a second current value I2 of the system low voltage Vss provided to the fourth transistor when the fourth transistor T4 is turned on. Here, the charging reference voltage Vref may limit/reduce the current value through a current-limiting circuit and/or trace layout technology, which should not be construed as a limitation in the disclosure.

Figure 1B:
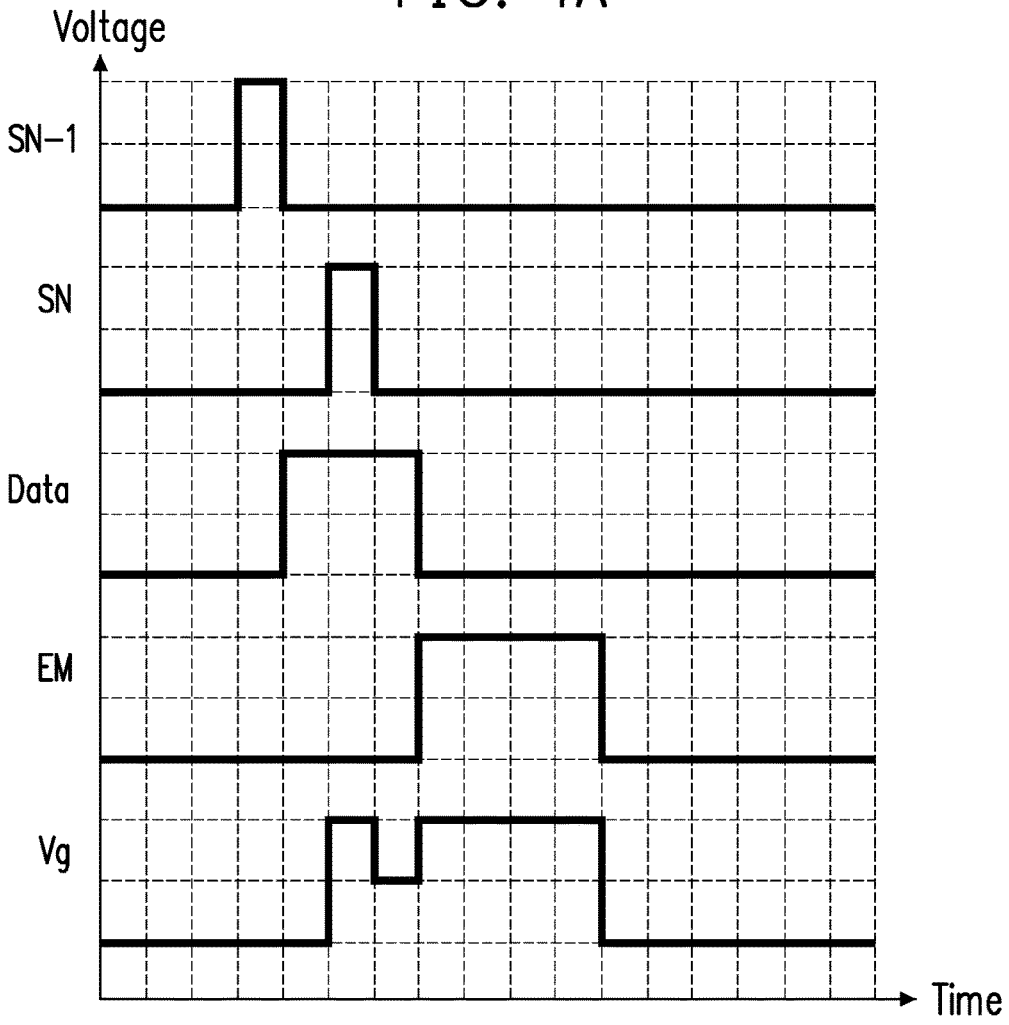
FIG. 1B is a schematic diagram of a driving waveform of the pixel circuit according to the first embodiment of the disclosure.

FIG. 1B is a schematic diagram of a driving waveform of the pixel circuit according to the first embodiment of the disclosure. With reference to FIG. 1A and FIG. 1B, in this embodiment, FIG. 1B may be deemed as illustrating a portion of the driving waveform during an image period. In detail, FIG. 1B depicts the driving waveform of the light-emitting signal EM and the first scan signal SN associated with the pixel circuit 100. An enabling period of the first scan signal SN is earlier than and does not overlap an enabling period of the light-emitting signal EM; that is, there is a time interval between the enabling period of the first scan signal SN and the light-emitting signal EM.

Further, in the enabling period of the first scan signal SN (i.e., a scan period of the pixel circuit 100), the third transistor T3 and the fifth transistor T5 are turned on, the first transistor T1 and the fourth transistor T4 are controlled by the disabled light-emitting signal EM and turned off, and the ON state of the second transistor T2 responds to a voltage Vg. At this time, the data voltage transmitted by the first data signal Data is written to the first capacitor C1, so that the first capacitor C1 stores a voltage difference between the data voltage of the first data signal Data and the charging reference voltage Vref.

After the enabling period of the first scan signal SN and before the enabling period of the light-emitting signal EM, the disabled first scan signal SN and light-emitting signal EM control the first transistor T1, the third transistor T3, the fourth transistor T4, and the fifth Transistor T5 to be turned off. At this time, the voltage Vg of the control terminal of the second transistor T2 (i.e., the voltage of the first terminal of the first capacitor C1) drops because of a feedthrough voltage generated by switching the third transistor T3 to be turned off from being turned on, and the voltage of the second terminal of the first capacitor C1 also drops because of the feedthrough voltage of the fifth transistor T5, so that a cross voltage of the first capacitor C1 remains unchanged (i.e., not affected by the feedthrough voltage).

In the enabling period of the light-emitting signal EM (i.e., a light-emitting period of the pixel circuit 100), the first transistor T1 and the fourth transistor T4 are turned on, the third transistor T3 and the fifth transistor T5 are controlled by the disabled first scan signal SN and turned off, and the ON state of the second transistor T2 responds to the voltage Vg, so as to control the current flowing through the micro light-emitting diode LED1 by the data voltage corresponding to the first data signal Data, thereby controlling the light-emitting brightness (i.e., a grayscale value) of the pixel circuit 100.

As such, the pixel circuit 100 may, through simultaneously turning on or off the third transistor T3 and the fifth transistor T5, eliminate/suppress the effect of the feedthrough voltage on the first capacitor C1. The writing of the data voltage is performed with use of the low-current charging reference voltage Vref (i.e., charging of the first capacitor C1), so as to reduce the voltage drop caused by the trace impedance and further eliminate/suppress the impact of the trace impedance on the writing of the data voltage. The light-emitting period of the micro light-emitting diode LED1 is controlled by simultaneously turning on or off the first transistor T1 and the fourth transistor T4, and current leakage may also be eliminated/suppressed.

Figure 2A:
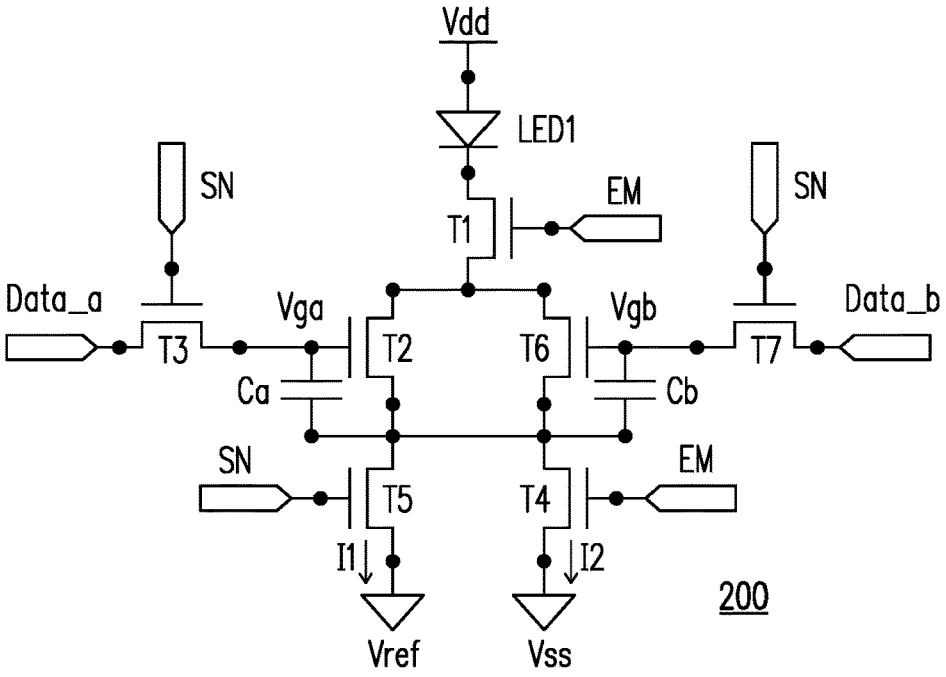
FIG. 2A is a schematic circuit diagram of a pixel circuit according to a second embodiment of the disclosure.

FIG. 2A is a schematic circuit diagram of a pixel circuit according to a second embodiment of the disclosure. With reference to FIG. 1A and FIG. 2A, in the embodiment, the pixel circuit 200 includes a light-emitting device, e.g., a micro light-emitting diode LED1 and/or an OLED, a first transistor T1, a second transistor T2, a third transistor T3, a fourth transistor T4, a fifth transistor T5, a sixth transistor T6, a seventh transistor T7, a first capacitor Ca, and a second capacitor Cb, wherein the coupling relationship of the micro light-emitting diode LED1, the first transistor T1, the second transistor T2, the third transistor T3, the fourth transistor T4, the fifth transistor T5, and the first capacitor Ca may refer to what is shown in FIG. 1A and will not be repeated hereinafter. Besides, the first terminal of the third transistor T1 receives a first data signal Data_a. The first transistor T1, the second transistor T2, the third transistor T3, the fourth transistor T4, the fifth transistor T5, the sixth transistor T6, and the seventh transistor T7 may be TFTs, which should not be construed as a limitation in the disclosure.

The sixth transistor T6 has a first terminal coupled to the second terminal of the first transistor T1, a second terminal coupled to the first terminal of the fourth transistor T4, and a control terminal. The second capacitor Cb has a first terminal coupled to the control terminal of the sixth transistor T6 and a second terminal coupled to the second terminal of the sixth transistor T6. The seventh transistor T7 has a first terminal that receives a second data signal Data_b, a second terminal coupled to the control terminal of the sixth transistor T6, and a control terminal that receives the first scan signal SN.

Figure 2B:
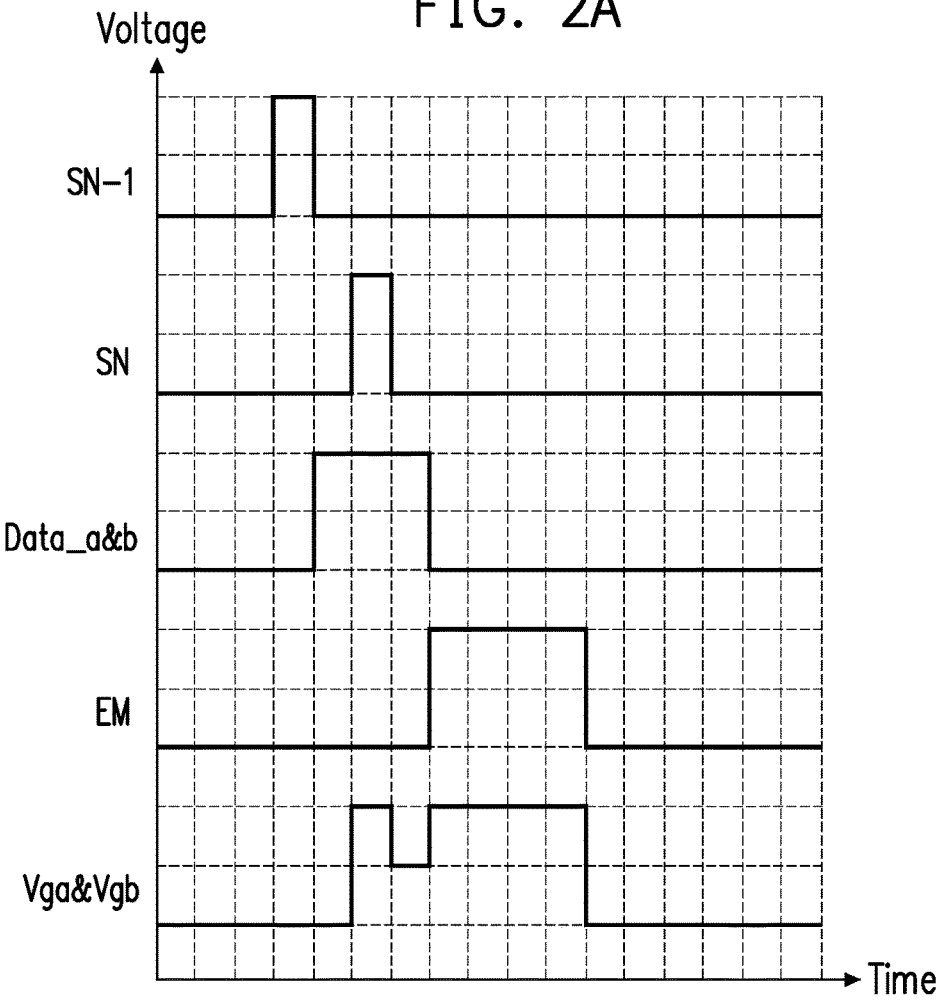
FIG. 2B is a schematic diagram of a driving waveform of the pixel circuit according to the second embodiment of the disclosure.

FIG. 2B is a schematic diagram of a driving waveform of the pixel circuit according to the second embodiment of the disclosure. With reference to FIG. 2A and FIG. 2B, in this embodiment, FIG. 2B may be deemed as illustrating a portion of the driving waveform during an image period. In detail, FIG. 2B depicts the driving waveform of the light-emitting signal EM and the first scan signal SN associated with the pixel circuit 200. The enabling period of the first scan signal SN is earlier than and does not overlap the enabling period of the light-emitting signal EM; that is, there is a time interval between the enabling period of the first scan signal SN and the light-emitting signal EM.

Further, in the enabling period of the first scan signal SN (i.e., the scan period of the pixel circuit 200), the third transistor T3, the fifth transistor T5, and the seventh transistor T7 are turned on, the first transistor T1 and the fourth transistor T4 are controlled by the disabled light-emitting signal EM and turned off, the ON state of the second transistor T2 responds to a voltage Vga, and the ON state of the sixth transistor T6 responds to a voltage Vgb. At this time, the data voltage transmitted by the first data signal Data_a is written to the first capacitor Ca, so that the first capacitor Ca stores a voltage difference between the data voltage of the first data signal Data_a and the charging reference voltage Vref; the data voltage transmitted by the second data signal Data_b is written to the second capacitor Cb, so that the second capacitor Cb stores a voltage difference between the data voltage of the second data signal Data_b and the charging reference voltage Vref.

After the enabling period of the first scan signal SN and before the enabling period of the light-emitting signal EM, the disabled first scan signal SN and light-emitting signal EM control the first transistor T1, the third transistor T3, the fourth transistor T4, the fifth transistor T5, the sixth transistor T6, and the seventh transistor T7 to be turned off. At this time, the voltage Vga of the control terminal of the second transistor T2 (i.e., the voltage of the first terminal of the first capacitor Ca) drops because of a feedthrough voltage generated by switching the third transistor T3 to be turned off from being turned on, and the voltage of the second terminal of the first capacitor Ca also drops because of the feedthrough voltage of the fifth transistor T5, so that the cross voltage of the first capacitor Ca remains unchanged (i.e., not affected by the feedthrough voltage). In addition, the voltage Vgb of the control terminal of the sixth transistor T6 (i.e., the voltage of the first terminal of the second capacitor Cb) drops because of the feedthrough voltage of the seventh transistor T7, and the voltage of the second terminal of the second capacitor Cb also drops because of the feedthrough voltage of the fifth transistor T5, so that the cross voltage of the second capacitor Cb remains unchanged (i.e., not affected by the feedthrough voltage).

In the enabling period of the light-emitting signal EM (i.e., the light-emitting period of the pixel circuit 200), the first transistor T1 and the fourth transistor T4 are turned on, and the third transistor T3, the fifth transistor T5, and the seventh transistor T7 are controlled by the disabled first scan signal SN and turned off. Besides, the ON state of the second transistor T2 responds to the voltage Vga, and the ON state of the sixth transistor T6 responds to the voltage Vgb, so as to control the current flowing through the micro light-emitting diode LED1 by the data voltage corresponding to the first data signal Data and the data voltage corresponding to the second data signal Data_b, thereby controlling the light-emitting brightness (i.e., the grayscale value) of the pixel circuit 200.

As such, the pixel circuit 200 may, through simultaneously turning on or off the third transistor T3, the fifth transistor T5, and the seventh transistor T7, eliminate/suppress the effect of the feedthrough voltage on the first capacitor Ca and the second capacitor Cb. The writing of the data voltage is performed with use of the low-current charging reference voltage Vref (i.e., charging of the first capacitor Ca and the second capacitor Cb), so as to reduce the voltage drop caused by the trace impedance and further eliminate/suppress the impact of the trace impedance on the writing of the data voltage. The light-emitting period of the micro light-emitting diode LED1 is controlled by simultaneously turning on or off the first transistor T1 and the fourth transistor T4, and current leakage may also be eliminated/suppressed.

In an embodiment of the disclosure, an aspect ratio of a channel of the second transistor T2 may be the same as an aspect ratio of a channel of the sixth transistor T6, or the aspect ratio of the channel of the second transistor T2 may be different from the aspect ratio of the channel of the sixth transistor T6. In addition, during the same scan period, the data voltage of the first data signal Data_a may be the same as the data voltage of the second data signal Data_b; namely, a voltage range of the first data signal Data_a may be the same as a voltage range of the second data signal Data_b. Alternatively, the data voltage of the first data signal Data_a may be different from the data voltage of the second data signal Data_b; namely, the voltage range of the first data signal Data_a may be different from the voltage range of the second data signal Data_b.

Figure 2C:
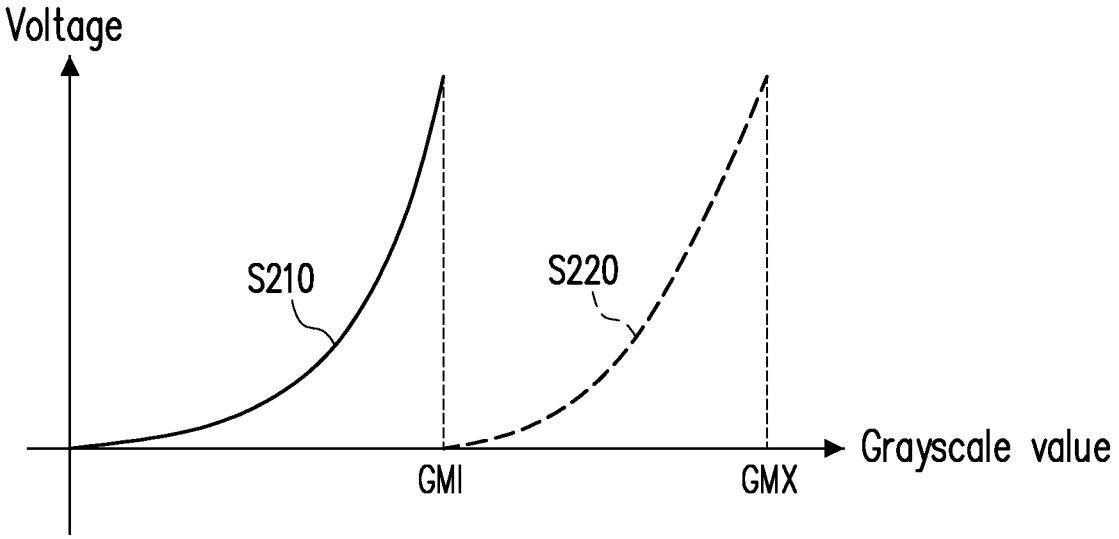
FIG. 2C schematically illustrates voltage distribution of a first data signal and a second data signal of the pixel circuit according to the second embodiment of the disclosure.

FIG. 2C schematically illustrates voltage distribution of a first data signal and a second data signal of the pixel circuit according to the second embodiment of the disclosure. With reference to FIG. 2A and FIG. 2C, in the embodiment of the disclosure, the aspect ratio of the channel of the second transistor T2 may be greater than the aspect ratio of the channel of the sixth transistor T6; that is, when the second transistor T2 and the sixth transistor T6 receive the same gate voltage (such as Vga, Vgb), a drain current provided by the second transistor T2 is greater than a drain current provided by the sixth transistor T6. At this time, the sixth transistor T6 with the low drain current may be applied to control the micro light-emitting diode LED1 to display a portion with a low grayscale level, and the second transistor T2 with the high drain current may be applied to control the micro light-emitting diode LED1 to display another portion with a high grayscale level.

According to the circuit operation, the current flowing through the micro light-emitting diode LED1 is the sum of the current flowing through the second transistor T2 and the current flowing through the sixth transistor T6, i.e., the sum of the drain current of the second transistor T2 and the drain current of the sixth transistor T6. Therefore, when the sum of the drain current of the sixth transistor T6 in the pixel circuit 200 makes the light-emitting brightness of the micro light-emitting diode LED1 to be an insulation grayscale brightness GMI, by setting the data voltage of the first data signal Data_a, the drain current of the second transistor T2 may vary within a grayscale range correspondingly greater than or equal to the insulation grayscale brightness GMI, and by setting the data voltage of the second data signal Data_b, the drain current of the sixth transistor T6 may vary within a grayscale range correspondingly less than or equal to the insulation grayscale brightness GMI. The insulation grayscale brightness GMI does not correspond to the maximum display brightness GMX (for instance, the grayscale level 255) and the minimum display brightness (for instance, the grayscale level 0) of the display brightness range of the micro light-emitting diode LED1.

Further, as shown by a curve S220, when the second transistor T2 controlled by first data signal Data_a is turned off in the enabling period of the light-emitting signal EM when the micro light-emitting diode LED1 displays a brightness less than or equal to the insulation grayscale brightness GMI, and the second transistor T2 controlled by the first data signal Data_a is turned on in the enabling period of the light-emitting signal EM when the micro light-emitting device LED1 displays a brightness greater than the insulation grayscale brightness GMI. As shown by a curve S210, the sixth transistor T6 controlled by the second data signal Data_b is in different conducting states in the enabling period of the light-emitting signal EM when the micro-light-emitting diode LED1 displays a brightness less than or equal to the insulation grayscale brightness GMI, and the sixth transistor T6 controlled by the second data signal Data_b is in the maximum ON state in the enabling period of the light-emitting signal EM when the micro-light-emitting diode LED1 displays a brightness greater than the insulation grayscale brightness GMI.

In other words, the first maximum grayscale voltage of the first data signal Data_a corresponds to the maximum display brightness GMX of the display brightness range of the micro light-emitting diode LED1, and the second maximum grayscale voltage of the second data signal Data_b corresponds to the insulation grayscale brightness GMI. Here, the first maximum grayscale voltage may be equal to the second maximum grayscale voltage. Since the first data signal Data_a and the second data signal Data_b respectively correspond to different grayscale level ranges, a high-bit gamma curve of the micro light-emitting diode LED1 may be realized; that is, the micro light-emitting diode LED1 may display a finer grayscale level even in a low grayscale level range.

In this embodiment, the insulation grayscale brightness GMI may be determined according to circuit requirements, and more specifically, the insulation grayscale brightness GMI may be determined according to a ratio of aspect ratios of transistors. In other words, the insulation grayscale brightness GMI may be associated with a first ratio of the aspect ratio of the channel of the second transistor T2 to the aspect ratio of the channel of the sixth transistor T6. As exemplified above, the higher the first ratio, the lower the insulation grayscale brightness GMI; the lower the first ratio, the higher the insulation grayscale brightness GMI.

In this embodiment, the sixth transistor T6, the seventh transistor T7, and the second capacitor Cb may be deemed as a current branch receiving one single data signal, and only one single current branch is shown in FIG. 2A; however, in other embodiments, the pixel circuit may have more current branches to receive different data signals, thereby increasing the number of bits of a gamma curve controlling the micro light-emitting diode LED1.

Figure 3A:
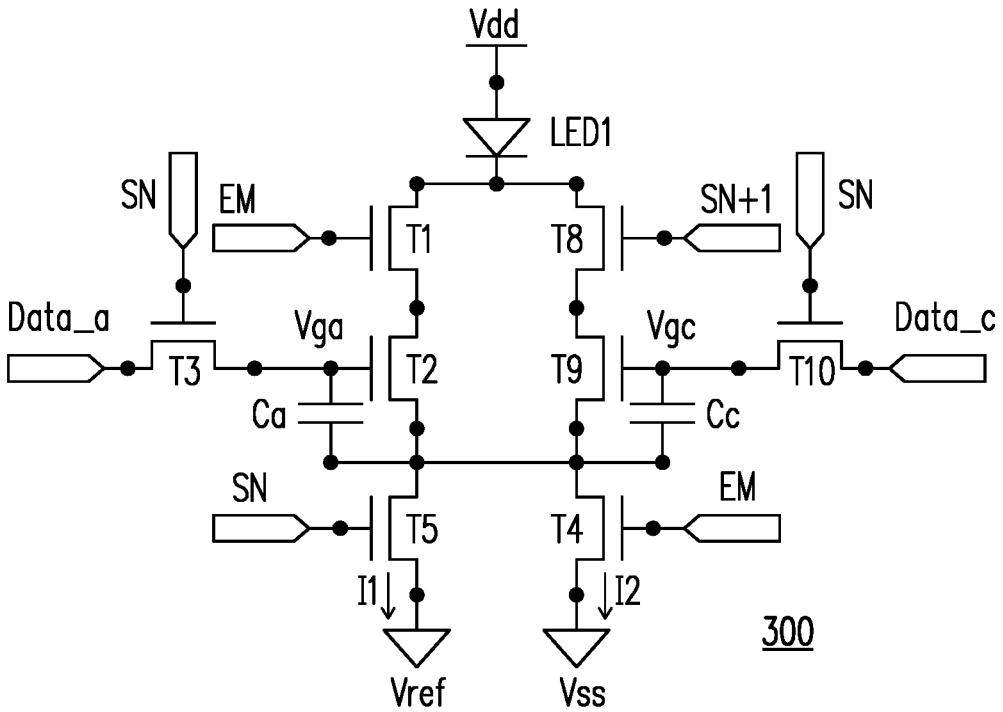
FIG. 3A is a schematic circuit diagram of a pixel circuit according to a third embodiment of the disclosure.

FIG. 3A is a schematic circuit diagram of a pixel circuit according to a third embodiment of the disclosure. With reference to FIG. 1A and FIG. 3A, in the embodiment, the pixel circuit 300 includes a light-emitting device, e.g., a micro light-emitting diode LED1 and/or an OLED, a first transistor T1, a second transistor T2, a third transistor T3, a fourth transistor T4, a fifth transistor T5, an eighth transistor T8, a ninth transistor T9, a tenth transistor T10, a first capacitor Ca, and a third capacitor Cc, wherein the coupling relationship of the micro light-emitting diode LED1, the first transistor T1, the second transistor T2, the third transistor T3, the fourth transistor T4, the fifth transistor T5, and the first capacitor Ca may refer to what is shown in FIG. 1A and will not be repeated hereinafter. Besides, the first terminal of the third transistor T1 receives the first data signal Data_a. The first transistor T1, the second transistor T2, the third transistor T3, the fourth transistor T4, the fifth transistor T5, the eighth transistor T8, the ninth transistor T9, and the tenth transistor T10 may be TFTs, which should not be construed as a limitation in the disclosure.

The eighth transistor T8 has a first terminal coupled to the cathode of the micro light-emitting diode LED1, a second terminal, and a control terminal receiving a second scan signal SN+1. The ninth transistor T9 has a first terminal coupled to the second terminal of the eighth transistor T8, a second terminal coupled to the first terminal of the fourth transistor T4, and a control terminal. The third capacitor Cc has a first terminal coupled to the control terminal of the ninth transistor T9 and a second terminal coupled to the second terminal of the ninth transistor T9. The tenth transistor T10 has a first terminal receiving a third data signal Data_c, a second terminal coupled to the control terminal of the ninth transistor T9, and a control terminal receiving the first scan signal SN.

Figure 3B:
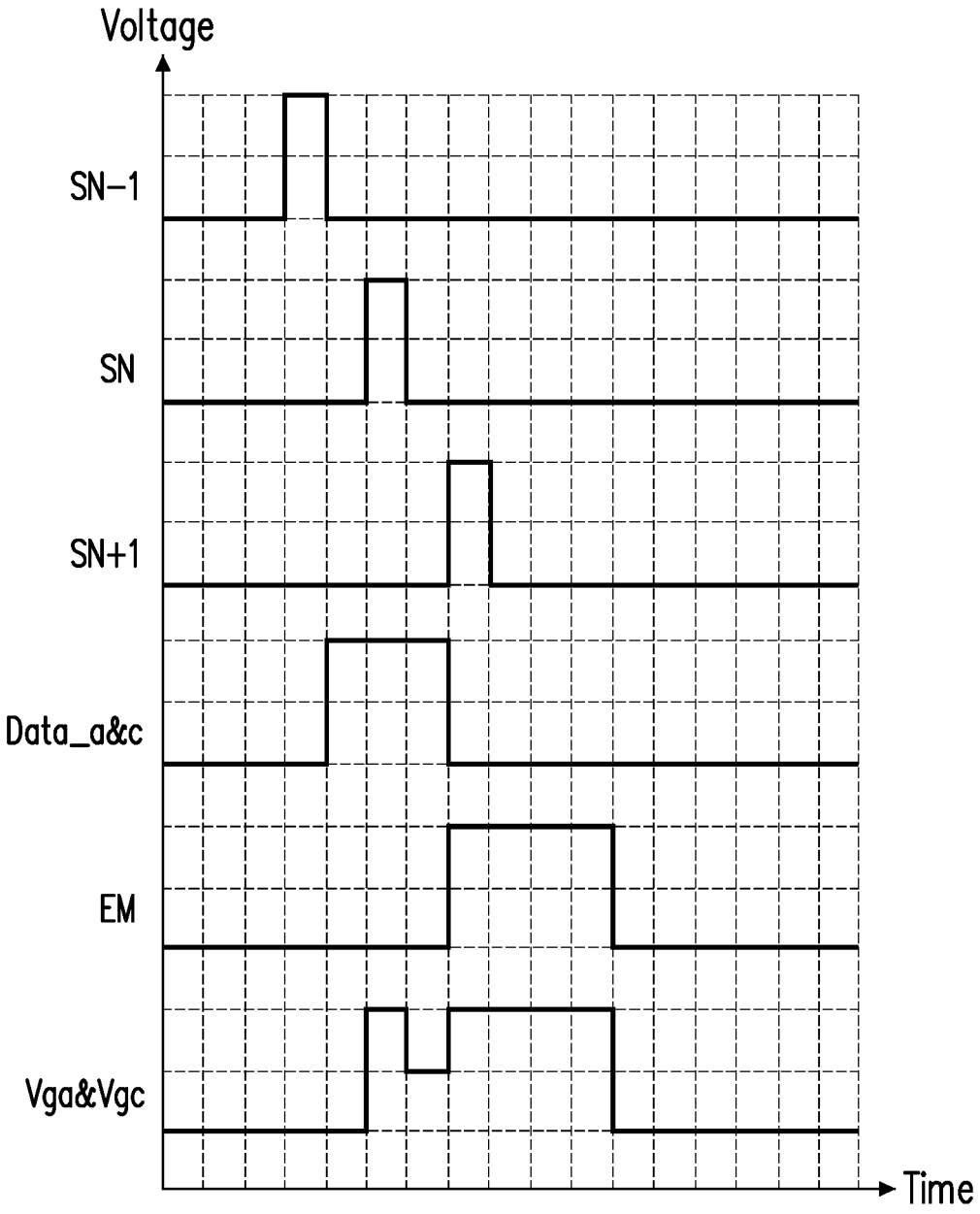
FIG. 3B is a schematic diagram of a driving waveform of the pixel circuit according to the third embodiment of the disclosure.

FIG. 3B is a schematic diagram of a driving waveform of the pixel circuit according to the third embodiment of the disclosure. With reference to FIG. 3A and FIG. 3B, in this embodiment, FIG. 3B may be deemed as illustrating a portion of the driving waveform during an image period. In detail, FIG. 3B depicts the driving waveform of the light-emitting signal EM, the first scan signal SN, and the second scan signal SN+1 associated with the pixel circuit 300. The enabling period of the first scan signal SN is earlier than and does not overlap the enabling period of the light-emitting signal EM, and the enabling period of the first scan signal SN does not overlap the enabling period of the light-emitting signal EM; that is, there is a time interval between the enabling period of the first scan signal SN and the light-emitting signal EM. Besides, an enabling period of the second scan signal SN+1 overlaps the enabling period of the light-emitting signal EM (i.e., surrounded by the enabling period of the light-emitting signal EM).

Further, in the enabling period of the first scan signal SN (i.e., the scan period of the pixel circuit 300), the third transistor T3, the fifth transistor T5, and the tenth transistor T10 are turned on, the first transistor T1 and the fourth transistor T4 are controlled by the disabled light-emitting signal EM and turned off, and the eighth transistor T8 is controlled by the disabled second scan signal SN+1 and turned off. The ON state of the second transistor T2 responds to the voltage Vga, and the ON state of the ninth transistor T9 responds to a voltage Vgc. At this time, the data voltage transmitted by the first data signal Data_a is written to the first capacitor Ca, so that the first capacitor Ca stores the voltage difference between the data voltage of the first data signal Data_a and the charging reference voltage Vref; the data voltage transmitted by the third data signal Data_c is written to the third capacitor Cc, so that the third capacitor Cc stores a voltage difference between the data voltage of the third data signal Data_c and the charging reference voltage Vref.

After the enabling period of the first scan signal SN and before the enabling period of the light-emitting signal EM, the disabled first scan signal SN, second scan signal SN+1, and light-emitting signal EM control the first transistor T1, the third transistor T3, the fourth transistor T4, the fifth transistor T5, the eighth transistor T8, the ninth transistor T9, and the tenth transistor T10 to be turned off. At this time, the voltage Vga of the control terminal of the second transistor T2 (i.e., the voltage of the first terminal of the first capacitor Ca) drops because of a feedthrough voltage generated by switching the third transistor T3 to be turned off from being turned on, and the voltage of the second terminal of the first capacitor Ca also drops because of the feedthrough voltage of the fifth transistor T5, so that the cross voltage of the first capacitor Ca remains unchanged (i.e., not affected by the feedthrough voltage). In addition, the voltage Vgc of the control terminal of the ninth transistor T9 (i.e., the voltage of the first terminal of the third capacitor Cc) drops because of the feedthrough voltage of the tenth transistor T10, and the voltage of the second terminal of the third capacitor Cc also drops because of the feedthrough voltage of the fifth transistor T5, so that the cross voltage of the second capacitor Cb remains unchanged (i.e., not affected by the feedthrough voltage).

In the enabling period of the light-emitting signal EM (i.e., the light-emitting period of the pixel circuit 300), the first transistor T1 and the fourth transistor T4 are turned on, the third transistor T3, the fifth transistor T5, and the tenth transistor T10 are controlled by the disabled first scan signal SN and turned off, and the eighth transistor T8 is controlled by the enabled second scan signal SN+1 and turned on in a partial period. Besides, the ON state of the second transistor T2 responds to the voltage Vga, and the ON state of the ninth transistor T9 responds to the voltage Vgc, so as to control the current flowing through the micro light-emitting diode LED1 corresponding to the data voltage corresponding to the first data signal Data_a and the data voltage corresponding to the third data signal Data_c, thereby controlling the light-emitting brightness (i.e., a grayscale value) of the pixel circuit 300.

As such, the pixel circuit 300 may, through simultaneously turning on or off the third transistor T3, the fifth transistor T5, and the tenth transistor T10, eliminate/suppress the effects of the feedthrough voltage on the first capacitor Ca and the third capacitor Cc. The writing of the data voltage is performed with use of the low-current charging reference voltage Vref (i.e., charging of the first capacitor Ca and the third capacitor Cc), so as to reduce the voltage drop caused by the trace impedance and further eliminate/suppress the impact of the trace impedance on the writing of the data voltage. The light-emitting period of the micro light-emitting diode LED1 is controlled by simultaneously turning on or off the first transistor T1 and the fourth transistor T4, and current leakage may also be eliminated/suppressed.

In the embodiment of the disclosure, the aspect ratio of the channel of the second transistor T2 may be the same as an aspect ratio of a channel of the ninth transistor T9, or the aspect ratio of the channel of the second transistor T2 may be different from the aspect ratio of the channel of the ninth transistor T9. In addition, during the same scan period, the data voltage of the first data signal Data_a may be the same as the data voltage of the third data signal Data_c; namely, the voltage range of the first data signal Data_a may be the same as a voltage range of the third data signal Data_c. Alternatively, the data voltage of the first data signal Data_a may be different from the data voltage of the third data signal Data_c; namely, the voltage range of the first data signal Data_a may be different from the voltage range of the third data signal Data_c.

For instance, the aspect ratio of the channel of second transistor T2 may be greater than the aspect ratio of the channel of the ninth transistor T9. At this time, when the second transistor T2 controlled by the first data signal Data_a is turned off in the enabling period of the light-emitting signal EM when the micro light-emitting diode LED1 displays a brightness less than or equal to the insulation grayscale brightness GMI, and the second transistor T2 controlled by the first data signal Data_a is turned on in the enabling period of the light-emitting signal EM when the micro light-emitting device LED1 displays a brightness greater than the insulation grayscale brightness GMI. The insulation grayscale brightness GMI does not correspond to the maximum display brightness and the minimum display brightness of the display brightness range of the micro light-emitting diode LED1.

In the embodiment of the disclosure, the first maximum grayscale voltage of the first data signal Data_a corresponds to the maximum display brightness, and the third maximum grayscale voltage of the third data signal Data_c corresponds to the insulation grayscale brightness GMI. Here, the first maximum grayscale voltage may be equal to the third maximum grayscale voltage. Besides, the insulation grayscale brightness may be associated a second ratio of a first product obtained by multiplying the aspect ratio of the channel of the second transistor T2 by the enabling period of the light-emitting signal EM to a second product obtained by multiplying the aspect ratio of the channel of the ninth transistor T9 by an enabling period of the second scan signal SN+1. At this time, when the higher the second ratio, the lower the insulation grayscale brightness; the lower the second ratio, the higher insulation grayscale brightness. The explanation of the above may be found in the embodiment depicted FIG. 2C and thus will not be repeated hereinafter.

To sum up, the pixel circuit provided in one or more embodiments of the disclosure performs the writing of the data voltage (i.e., charging of the first capacitor) through the low-current charging reference voltage, so as to reduce voltage drop resulting from the trace impedance and further eliminate/suppress the influence of the trace impedance on the writing of the data voltage.

It will be apparent to those skilled in the art that various modifications and variations can be made to the disclosed embodiment without departing from the scope or spirit of the disclosure. In view of the foregoing, it is intended that the disclosure covers modifications and variations provided that they fall within the scope of the following claims and their equivalents.

What is claimed is:

1. A pixel circuit comprising:

a light-emitting device having an anode receiving a system high voltage and a cathode;

a first transistor having a first terminal coupled to the cathode of the light-emitting device, a second terminal, and a control terminal receiving a light-emitting signal;

a second transistor having a first terminal coupled to the second terminal of the first transistor, a second terminal, and a control terminal;

a first capacitor having a first terminal coupled to the control terminal of the second transistor and a second terminal coupled to the second terminal of the second transistor;

a third transistor having a first terminal receiving a first data signal, a second terminal coupled to the control terminal of the second transistor, and a control terminal receiving a first scan signal;

a fourth transistor having a first terminal coupled to the second terminal of the second transistor, a second terminal receiving a system low voltage, and a control terminal receiving the light-emitting signal; and a fifth transistor having a first terminal coupled to the second terminal of the second transistor, a second terminal receiving a charging reference voltage, and a control terminal receiving the first scan signal;

wherein a first current value of the charging reference voltage provided to the fifth transistor when the fifth transistor is turned on is smaller than a second current value of the system low voltage provided to the fourth transistor when the fourth transistor is turned on, wherein an enabling period of the first scan signal is earlier than an enabling period of the light-emitting signal, and the enabling period of the first scan signal does not overlap the enabling period of the light-emitting signal.

2. The pixel circuit according to claim 1, further comprising:

a sixth transistor having a first terminal coupled to the second terminal of the first transistor, a second terminal coupled to the first terminal of the fourth transistor, and a control terminal;

a second capacitor having a first terminal coupled to the control terminal of the sixth transistor and a second terminal coupled to the second terminal of the sixth transistor; and a seventh transistor having a first terminal receiving a second data signal, a second terminal coupled to the control terminal of the sixth transistor, and a control terminal receiving the first scan signal.

3. The pixel circuit according to claim 2, wherein the second transistor controlled by the first data signal is turned off when the light-emitting device displays a brightness less than or equal to an insulation grayscale brightness, the second transistor controlled by the first data signal is turned on when the light-emitting device displays a brightness greater than the insulation grayscale brightness during the enabling period of the light-emitting signal, and the insulation grayscale brightness does not correspond to a maximum display brightness and a minimum display brightness of a display brightness range of the light-emitting device.

4. The pixel circuit according to claim 3, wherein a first maximum grayscale voltage of the first data signal corresponds to the maximum display brightness, and a second maximum grayscale voltage of the second data signal corresponds to the insulation grayscale brightness.

5. The pixel circuit according to claim 1, further comprising:

an eighth transistor having a first terminal, a second terminal coupled to the cathode of the light-emitting device, and a control terminal receiving a second scan signal;

a ninth transistor having a first terminal coupled to the second terminal of the eighth transistor, a second terminal coupled to the first terminal of the fourth transistor, and a control terminal;

a third capacitor having a first terminal coupled to the control terminal of the ninth transistor and a second terminal coupled to the second terminal of the ninth transistor; and a tenth transistor having a first terminal receiving a third data signal, a second terminal coupled to the control terminal of the ninth transistor, and a control terminal receiving the first scan signal.

6. The pixel circuit according to claim 5, wherein the second transistor controlled by the first data signal is turned off when the light-emitting device displays a brightness less than or equal to an insulation grayscale brightness, the second transistor controlled by the first data signal is turned on when the light-emitting device displays a brightness greater than the insulation grayscale brightness during an enabling period of the light-emitting signal, and the insulation grayscale brightness does not correspond to a maximum display brightness and a minimum display brightness of a display brightness range of the light-emitting device.

7. A pixel circuit comprising:

a light-emitting device having an anode receiving a system high voltage and a cathode;

a first transistor having a first terminal coupled to the cathode of the light-emitting device, a second terminal, and a control terminal receiving a light-emitting signal;

a second transistor having a first terminal coupled to the second terminal of the first transistor, a second terminal, and a control terminal;

a first capacitor having a first terminal coupled to the control terminal of the second transistor and a second terminal coupled to the second terminal of the second transistor;

a third transistor having a first terminal receiving a first data signal, a second terminal coupled to the control terminal of the second transistor, and a control terminal receiving a first scan signal;

a fourth transistor having a first terminal coupled to the second terminal of the second transistor, a second terminal receiving a system low voltage, and a control terminal receiving the light-emitting signal; and a fifth transistor having a first terminal coupled to the second terminal of the second transistor, a second terminal receiving a charging reference voltage, and a control terminal receiving the first scan signal;

wherein an enabling period of the first scan signal is earlier than an enabling period of the light-emitting signal, the enabling period of the first scan signal does not overlap the enabling period of the light-emitting signal, and there is a time interval between the enabling period of the first scan signal and the enabling period of the light-emitting signal.

8. The pixel circuit according to claim 7, wherein a first current value of the charging reference voltage provided to the fifth transistor when the fifth transistor is turned on is smaller than a second current value of the system low voltage provided to the fourth transistor when the fourth transistor is turned on.

9. The pixel circuit according to claim 7, further comprising:

a sixth transistor having a first terminal coupled to the second terminal of the first transistor, a second terminal coupled to the first terminal of the fourth transistor, and a control terminal;

a second capacitor having a first terminal coupled to the control terminal of the sixth transistor and a second terminal coupled to the second terminal of the sixth transistor; and a seventh transistor having a first terminal receiving a second data signal, a second terminal coupled to the control terminal of the sixth transistor, and a control terminal receiving the first scan signal.

10. The pixel circuit according to claim 9, wherein an aspect ratio of a channel of the second transistor is greater than an aspect ratio of a channel of the sixth transistor.

11. The pixel circuit according to claim 10, wherein the second transistor controlled by the first data signal is turned off when the light-emitting device displays a brightness less than or equal to an insulation grayscale brightness, the second transistor controlled by the first data signal is turned on when the light-emitting device displays a brightness greater than the insulation grayscale brightness during the enabling period of the light-emitting signal, and the insulation grayscale brightness does not correspond to a maximum display brightness and a minimum display brightness of a display brightness range of the light-emitting device.

12. The pixel circuit according to claim 11, wherein a first maximum grayscale voltage of the first data signal corresponds to the maximum display brightness, and a second maximum grayscale voltage of the second data signal corresponds to the insulation grayscale brightness.

13. The pixel circuit according to claim 12, wherein the first maximum grayscale voltage is equal to the second maximum grayscale voltage.

14. The pixel circuit according to claim 11, wherein the insulation grayscale brightness is associated with a first ratio of the aspect ratio of the channel of the second transistor to the aspect ratio of the channel of the sixth transistor.

15. The pixel circuit according to claim 14, wherein the higher the first ratio, the lower the insulation grayscale brightness, and the lower the first ratio, the higher the insulation grayscale brightness.

16. The pixel circuit according to claim 7, further comprising:

an eighth transistor having a first terminal, a second terminal coupled to the cathode of the light-emitting device, and a control terminal receiving a second scan signal;

a ninth transistor having a first terminal coupled to the second terminal of the eighth transistor, a second terminal coupled to the first terminal of the fourth transistor, and a control terminal;

a third capacitor having a first terminal coupled to the control terminal of the ninth transistor and a second terminal coupled to the second terminal of the ninth transistor; and a tenth transistor having a first terminal receiving a third data signal, a second terminal coupled to the control terminal of the ninth transistor, and a control terminal receiving the first scan signal.

17. The pixel circuit according to claim 16, wherein the second transistor controlled by the first data signal is turned off when the light-emitting device displays a brightness less than or equal to an insulation grayscale brightness, the second transistor controlled by the first data signal is turned on when the light-emitting device displays a brightness greater than the insulation grayscale brightness during the enabling period of the light-emitting signal, and the insulation grayscale brightness does not correspond to a maximum display brightness and a minimum display brightness of a display brightness range of the light-emitting device.

18. The pixel circuit according to claim 17, wherein a first maximum grayscale voltage of the first data signal corresponds to the maximum display brightness, and a third maximum grayscale voltage of the third data signal corresponds to the insulation grayscale brightness.

19. The pixel circuit according to claim 18, wherein the first maximum grayscale voltage is equal to the third maximum grayscale voltage.

20. The pixel circuit according to claim 19, wherein the insulation grayscale brightness is associated with a second ratio of a first product obtained by multiplying the aspect ratio of the channel of the second transistor by the enabling period of the light-emitting signal to a second product obtained by multiplying the aspect ratio of the channel of the ninth transistor by the enabling period of the second scan signal.

* * * * *